US005401144A

United States Patent [19]

Fujii et al.

[11] Patent Number: 5,401,144

[45] Date of Patent: Mar. 28, 1995

[54] SWASH PLATE TYPE REFRIGERANT COMPRESSOR

[75] Inventors: Toshiro Fujii; Kazuo Murakami; Koichi Ito; Kazuaki Iwama, all of Kariya, Japan

[73] Assignee: Kabushiki Kaisha Toyoda Jisoshokki Seisakusho, Tokyo, Japan

[21] Appl. No.: 60,813

[22] Filed: May 12, 1993

[30] Foreign Application Priority Data

May 13, 1992 [JP] Japan ..... 4-120754

[51] Int. Cl.[6] ..... F04B 1/12

[52] U.S. Cl. ..... 417/269; 91/499

[58] Field of Search ..... 417/222.2, 269; 91/499, 91/503; 62/509, 197; 137/625.21, 625.22, 625.23

[56] References Cited

U.S. PATENT DOCUMENTS

| | | | |
|---|---|---|---|
| 1,367,914 | 2/1921 | Larsson | 91/160 |
| 2,160,978 | 6/1939 | Mock | 417/269 |
| 2,671,606 | 3/1954 | Ricardo | 417/270 |
| 3,498,227 | 3/1970 | Kita | 91/499 |
| 3,696,710 | 10/1972 | Ortelli | 137/625.21 |
| 4,007,663 | 2/1977 | Nagatomo et al. | 417/269 |
| 4,061,443 | 12/1977 | Black et al. | 417/222.1 |
| 4,781,539 | 11/1988 | Ikeda et al. | 417/269 |
| 4,872,814 | 10/1989 | Skinner et al. | 417/222.2 |
| 5,009,574 | 4/1991 | Ikeda et al. | 417/269 |
| 5,207,078 | 5/1993 | Kimura | 417/269 |
| 5,232,349 | 8/1993 | Kimura et al. | 417/269 |

FOREIGN PATENT DOCUMENTS

| | | | |
|---|---|---|---|
| 957030 | 2/1950 | France | 417/269 |
| 2275662 | 6/1974 | France . | |
| 350135 | 3/1922 | Germany . | |
| 35082 | 2/1987 | Japan | 417/269 |
| 175557 | 8/1987 | Japan | 417/269 |
| 417337 | 1/1964 | Switzerland . | |
| 163857 | 6/1921 | United Kingdom . | |

*Primary Examiner*—Richard A. Bertsch
*Assistant Examiner*—Peter Korytnyk
*Attorney, Agent, or Firm*—Burgess, Ryan & Wayne

[57] ABSTRACT

A swash plate type refrigerant compressor having an axial cylinder block assembly having therein a double-headed piston operated compressing mechanism for compressing refrigerant gas introduced from an external air-conditioning system to a plurality of cylinder bores, the compressor further having a swash plate chamber capable of not only permitting a swash plate to rotate to thereby reciprocating the pistons but also receiving the refrigerant gas before compression, a rotary valve capable of controlling distribution of the refrigerant gas from the swash plate chamber to each of the cylinder bores, and a pair of taper roller bearings mounted in front and rear housings attached to the cylinder block assembly, and rotatably and stably supporting a drive shaft for mounting thereon the swash plate. The front and rear housings having only a discharge chamber for receiving the compressed refrigerant gas, respectively.

8 Claims, 5 Drawing Sheets

II
II
1
2
3
3a
3b
4
5
6
7
8
9a
9b
11
12
12a
12b
12c
12d
13
14a
14b
15
16
17
19
20a
20b
21a
21b
22a
22b
23a
23b
24a
24b
26

SWASH PLATE TYPE REFRIGERANT COMPRESSOR

BACKGROUND OF THE INVENTION

1. Field of the Invention

The present invention relates to a swash plate type refrigerant compressor non-exclusively adapted for use in compression of a refrigerant gas for an air-conditioning system of an automobile. More particularly, it relates to the internal construction of a swash plate type compressor having double-headed and swash plate-operated reciprocatory pistons and a rotary control valve for distributing refrigerant gas from a suction chamber to each of cylinder bores.

2. Description of the Related Art

U.S. Pat. No. 4,781,539 to Ikeda et al and assigned to the same Assignee as the present patent application discloses a typical swash plate type refrigerant compressor having double-headed reciprocatory pistons. The typical swash plate type refrigerant compressor having double-headed pistons is provided with a cylinder block in which a plurality of axial cylinder bores is formed to permit the double-headed pistons to reciprocate therein thereby effecting suction and compression of the refrigerant gas, and delivery of the compressed refrigerant gas. The cylinder block is also provided with a swash plate chamber formed therein so as to permit the swash plate mounted on a drive shaft to rotate together with the drive shaft.

Another typical swash plate type refrigerant compressor similar to the compressor of U.S. Pat. No. 4,781,539 is shown in FIGS. 4 and 5. Referring to FIGS. 4 and 5, the swash plate type refrigerant compressor includes a pair of front and rear cylinder blocks 33*a* and 33*b* axially combined together by using a plurality of screw bolts 35, and an axial drive shaft 34 rotatably supported by the cylinder blocks 33*a* and 33*b* via rotary bearings 41. The axially combined cylinder blocks 33*a* and 33*b* are provided with a plurality of pairs of axially aligned cylinder bores 42*a* and 42*b* in which double-headed pistons 36 are slidably received, and a swash plate chamber 48 for receiving a swash plate 37. The respective pairs of cylinder bores 42*a* and 42*b* are equiangularly arranged around the axis of the drive shaft 34, as best illustrated in FIG. 5.

The drive shaft 34 has the above-mentioned swash plate 37 that is fixedly supported thereon so as to be capable of rotating together with the drive shaft. The swash plate 37 is axially supported by a pair of thrust bearings 40 arranged between inner shoulders of the front and rear cylinder blocks 33*a*, 33*b* and the swash plate 37 per se. Namely, any thrust force axially acting on the swash plate 37 and the drive shaft 34 during the compressing of the refrigerant gas is assumed by the thrust bearings 40, and thus the drive shaft 34 and the swash plate 37 are capable of rotating smoothly.

Each of the double-headed pistons 36 is provided with a recess 38 formed therein at a middle portion thereof and opening radially inwardly with respect to the axis of the drive shaft 34 so as to permit the swash plate 37 to pass through each piston 36 during rotating of the swash plate 37. In the recess 38 of each double-headed piston 36, a pair of semi-spherical shoes 39 operatively engaging the swash plate 37 with the double-headed piston 36 are arranged so as to smoothly generate a reciprocatory motion of the double-headed piston 36 from the rotational motion of the swash plate 37.

Thus, during one complete rotation of the drive shaft 34 and the swash plate 37, each of the double-headed pistons 36 implements one complete stroke of reciprocation to thereby effect suction, compression and discharge of the refrigerant gas.

Front and rear housings 44 and 45 sealingly attached to the ends of the axially combined cylinder blocks 33*a* and 33*b* via front and rear valve plates 43*a* and 43*b* are provided with front and rear suction chambers 46*a* and 46*b*, and front and rear discharge chambers 47*a* and 47*b* formed therein, respectively. The suction chambers 46*a* and 46*b* of the front and rear housings 44 and 45 are communicated with the swash plate chamber 48 via passageways 51*a* and 51*b* formed in the front and rear cylinder blocks 33*a* and 33*b*. Thus, the refrigerant gas before compression returning from the external air-conditioning system is received by the swash plate chamber 48, and is further conveyed into the suction chambers 46*a* and 46*b* via the passageways 51*a* and 51*b*. The refrigerant gas entering the suction chamber 46*a* and 46*b* is further drawn into respective cylinder bores 42*a* and 42*b* via suction ports 49*a* and 49*b* formed in the front and rear valve plates 43*a* and 43*b* in response to the reciprocatory motion of the double-headed pistons 36.

The refrigerant gas in the respective cylinder bores 42*a* and 42*b* is compressed by the double-headed pistons 36, and the compressed refrigerant gas is discharged from the respective cylinder bores 42*a* and 42*b* toward the discharge chambers 47*a* and 47*b* of the front and rear housings 44 and 45 through discharge ports 50*a* and 50*b* formed in the front and rear valve plates 43*a* and 43*b*. The compressed refrigerant gas is then delivered from the discharge chambers 47*a* and 47*b* toward the air-conditioning system.

Nevertheless, when a consideration is given to the internal construction of the above-described conventional swash plate type refrigerant compressor, it is understood that an internal route of the refrigerant gas extending from the gas inlet of the compressor to each cylinder bore 42*a* or 42*b* is very long resulting in pressure loss of the refrigerant gas, and accordingly, the compression efficiency of the swash plate type refrigerant compressor is lowered while making it difficult to lessen the overall size of the compressor body.

Further, since each of the front and rear housings 44 and 45 is provided with both suction and discharge chambers 46*a*, 47*a* and 46*b*, 47*b*, it is difficult to obtain a sufficient spacing in both housings for arranging anti-friction and load supporting bearings for the drive shaft 34 without provision of any extension of the housings. Therefore, the anti-friction and thrust assuming bearings 40 and 41 must be arranged in the combined cylinder blocks 33*a* and 33*b*. However, the combined cylinder blocks per se are provided with only a limited amount of spacing for incorporating therein the anti-friction and thrust assuming bearings. Accordingly, two different kinds of bearings, i.e., a pair of anti-friction rotary bearings 41 and the other pair of thrust bearings 40 are individually arranged in the limited amount of spacing within the combined cylinder blocks 33*a* and 33*b* for supporting the drive shaft 34 and the swash plate 37. Consequently, neither the distance between the two thrust bearings 40, nor that between the two rotary bearings 41 can be long enough to stably support the drive shaft 34 and the swash plate 37 over a wide range of rotating speeds of the drive shaft 34 and the swash plate 37. As a result, the drive shaft 34 and the swash plate 37 is apt to vibrate when a large load applied to the compressor. This results in a reduction of the reliability of the swash plate type refrigerant compressor.

SUMMARY OF THE INVENTION

Therefore, a principal object of the present invention is to provide a swash plate type refrigerant compressor having an internal construction therein capable of shortening a suction route of the refrigerant gas extending from a gas inlet toward each of the cylinder bores to thereby reduce a pressure loss during suction of the refrigerant gas.

Another object of the present invention is to provide a swash plate type refrigerant compressor provided with an internal construction thereof capable of stably supporting rotating elements such as a drive shaft and a swash plate over a wide operation range from a low load to a high load operation to thereby ensure the reliable operation of the compressor.

In accordance with the present invention, there is provided a swash plate type refrigerant compressor comprising: a cylinder block unit provided with a plurality of axial cylinder bores arranged around an axis thereof at a circumferential spacing between adjacent cylinder bores, and a swash plate chamber defined in a substantially middle portion of the cylinder block means; a plurality of reciprocatory pistons slidably fitted in the plurality of cylinder bores; an axial drive shaft rotatably supported in the cylinder block; a swash plate fixedly mounted on the drive shaft so as to rotate in the swash plate chamber together with the drive shaft, the swash plate being operatively engaged with the plurality of pistons to thereby reciprocate the plurality of pistons during the rotation of the swash plate; a gas inlet means provided in the cylinder block means for introducing a refrigerant gas before compression from the exterior of the compressor into the swash plate chamber of the cylinder block means; and a rotary valve means mounted on the drive shaft so as to be rotated together with the drive shaft, the rotary valve means being provided with at least one gas distribution passageway formed therein and capable of establishing a fluid route enabling the refrigerant gas before compression to be distributed from the swash plate chamber to each of the plurality of cylinder bores during only suction stroke of each of the plurality of pistons in each of the plurality of cylinder bores, the rotary valve means being further provided with means for blocking the fluid route during the compression stroke of each of the plurality of pistons in each of the plurality of cylinder bores of the cylinder block means.

The swash plate type refrigerant compressor further comprises a housing means sealingly attached to ends of the cylinder block means for providing therein a discharge chamber for the refrigerant gas after compression, the discharge chamber being fluidly communicated with the plurality of cylinder bores during a discharge stroke of each of the pistons in each of the plurality of cylinder bores to thereby receive the refrigerant gas after compression discharged from each of the plurality of cylinder bores.

The drive shaft of the compressor is axially extended through a central portion of the cylinder block means and rotatably supported by bearing means capable of assuming both radial and thrust loads acting on the drive shaft and the swash plate, the bearing means being arranged in the housing means.

BRIEF DESCRIPTION OF THE DRAWINGS

The above and other objects, features and advantages of the present invention will be made apparent from the ensuing description of a preferred embodiment thereof in conjunction with the accompanying drawings wherein.

DESCRIPTION OF THE PREFERRED EMBODIMENT

Figure 1:
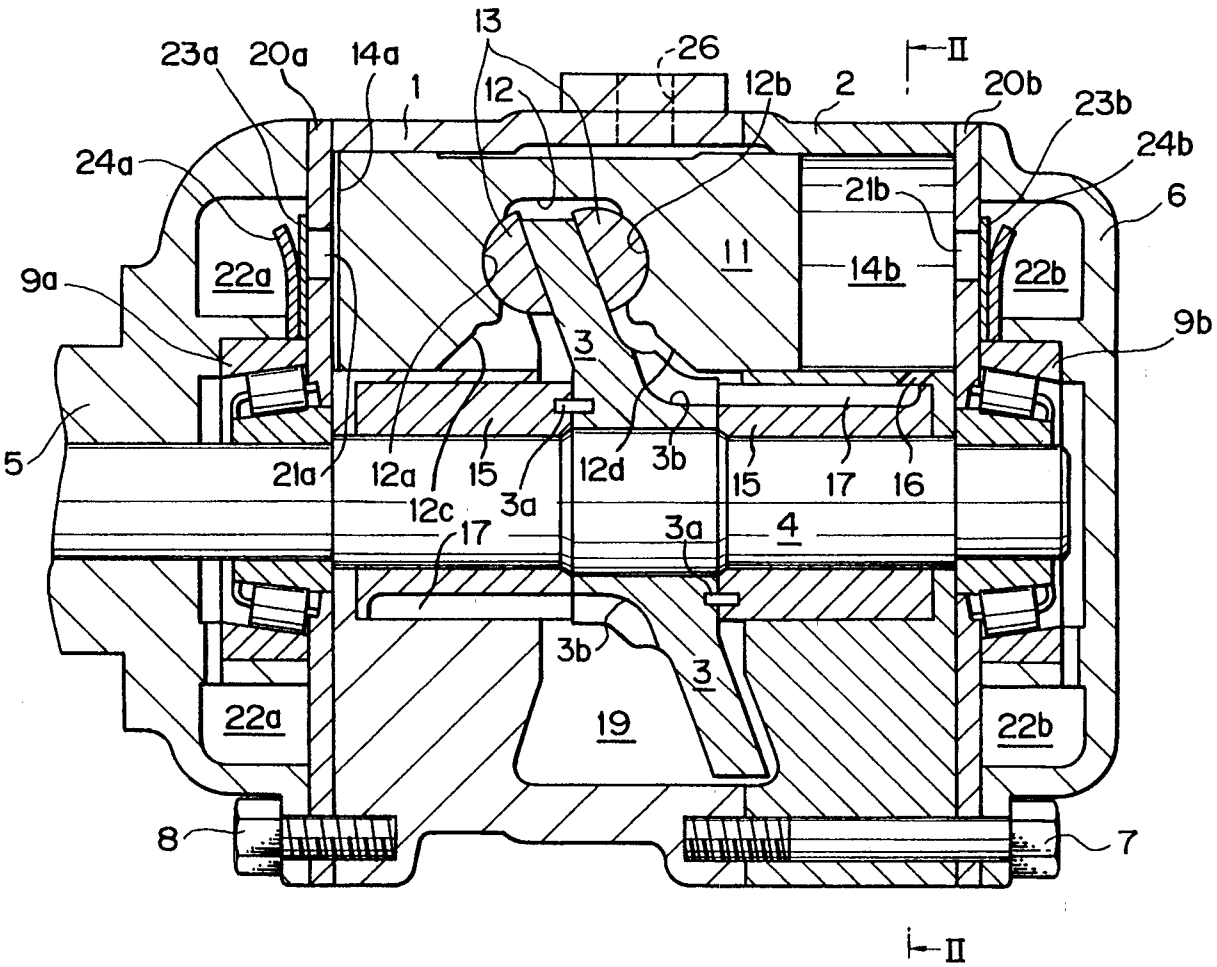
FIG. 1 is a longitudinal cross-sectional view of a swash plate type refrigerant compressor according to an embodiment of the present invention.

Referring to FIG. 1, a swash plate type refrigerant compressor according to an embodiment of the present invention is provided with a substantially cylindrical cylinder block assembly including a pair of front and rear cylinder blocks 1 and 2 through which an axial drive shaft 4 is extended to support a swash plate 3 at an axially middle portion of the cylinder block assembly.

A front housing 5 is fixedly connected to a front end of the front cylinder block 1 via a valve plate 20*a*, and a rear housing 6 is fixedly connected to a rear end of the rear cylinder block 2 via a rear valve plate 20*b*. The front and rear cylinder blocks 1 and 2, the front and rear housings 5 and 6, and the front and rear valve plates 20*a* and 20*b* are axially air-tightly combined together by screw bolts 7 and 8.

The cylinder block assembly including the front and rear cylinder blocks 1 and 2 is provided with a plurality of pairs of front and rear axially aligned cylinder bores 14*a* and 14*b*. In the illustrated cylinder block assembly, five pairs of cylinder bores 14*a* and 14*b* are substantially equi-angularly arranged around the axis of the drive shaft 4. However, the number of pairs of cylinder blocks 14*a* and 14*b* may be altered as required. In respective pairs of cylinder bores 14*a* and 14*b*, double-headed pistons 11 are slidably received to effect suction, compression, and discharge of the refrigerant gas.

The cylinder block assembly is also provided with a closed swash plate chamber 19 at an axially middle portion thereof for receiving therein the swash plate 3 rotating together with the drive shaft 4. The swash plate chamber 19 is capable of being fluidly connected to an external subsidiary unit (not shown) via a gas inlet port 26, and therefore the refrigerant gas to be compressed flows into the swash plate chamber 19, via the subsidiary unit and the gas inlet port 26.

The double-headed pistons 11 are engaged with the swash plate 3 via semi-spherical shoes 13, and are reciprocated in the axially aligned cylinder bores 14*a* and 14*b* in response to the rotation of the swash plate 3 and the drive shaft 4. The semi-spherical shoes 13 are slidably mounted in spherically socketed bores 12*a* and 12*b* formed in radial recesses 12 of respective double-headed pistons 11.

The front and rear housings 5 and 6 are provided with a front and a rear discharge chamber 22a and 22b, respectively. The front discharge chamber 22a is capable of being communicated with all front cylinder bores 14a to receive the compressed refrigerant gas when front discharge ports 21a are opened by front discharge valves 23a, and the rear discharge chamber 22b is capable of being communicated with all of the rear cylinder bores 14b to receive the compressed refrigerant gas when rear discharge ports 21b are opened by rear discharge valves 23b. The front and rear discharge valves 23a and 23b preferably formed as a reed valve made of elastic material e.g., a thin metallic plate can function as a check valve, respectively, preventing a reverse flow of the compressed refrigerant gas from the discharge chambers 22a and 22b toward the front and rear cylinder bores 14a and 14b. The movement of the reed-form discharge valves 23a and 23b for opening the discharge ports 21a and 21b are limited by front and rear valve retainers 24a and 24b, respectively.

The discharge valves 23a and 23b are opened when a pressure level prevailing in the cylinder bores 14a and 14b rises to a predetermined pressure level according to the compression of the refrigerant gas, and are elastically closed when the front and rear cylinder bores 14a and 14b are in the suction phase for drawing the refrigerant gas thereinto.

As will be understood from the illustration of FIG. 1, neither the front housing 5 nor the rear housings 6 of the swash plate type refrigerant compressor according to the present invention is provided with a suction chamber for receiving the refrigerant gas before compression.

Further, the front and rear housings 5 and 6 receive therein anti-friction and thrust assuming bearings 9a and 9b for rotatably supporting the drive shaft 4. Namely, the bearings 9a and 9b consist of conventional taper roller bearings capable of assuming both radial and thrust force. Since the bearings 9a and 9b are located outside the front and rear cylinder blocks 5 and 6, an axial spacing between the two taper roller bearings 9a and 9b is large enough for stably supporting the drive shaft 4.

The drive shaft 4 is driven by an external drive source, i.e., a vehicle engine, via a power transmission device. The drive power is applied to an outer end of the drive shaft 4, that is the leftmost end in FIG. 1.

Figure 3A:
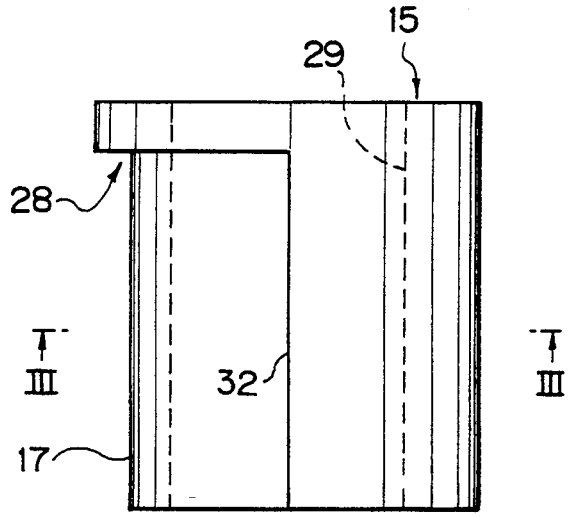
FIG. 3A is a side view of a rotary valve incorporated in the compressor of FIG. 1.
Figure 3B:
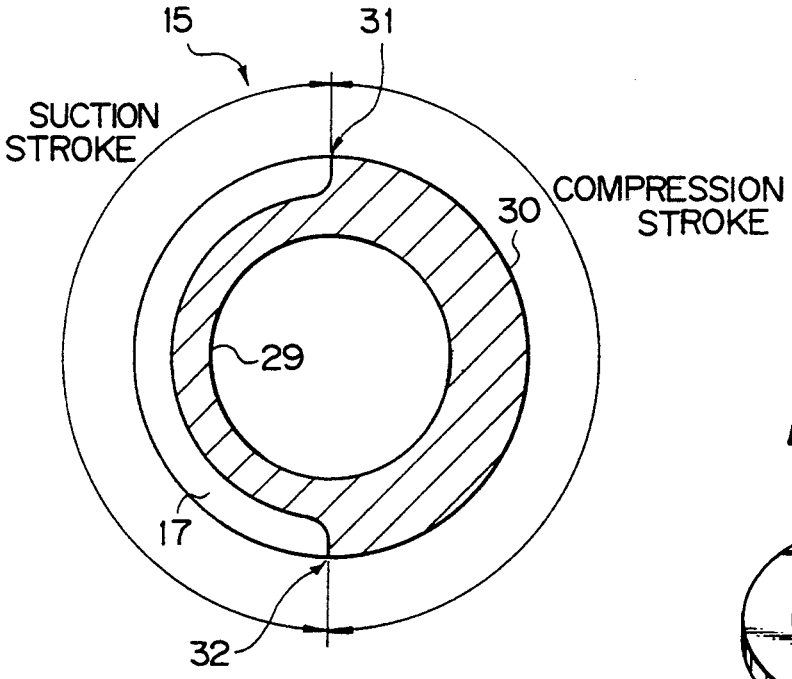
FIG. 3B is a cross-sectional view taken along the line III—III of FIG. 3A.
Figure 3C:
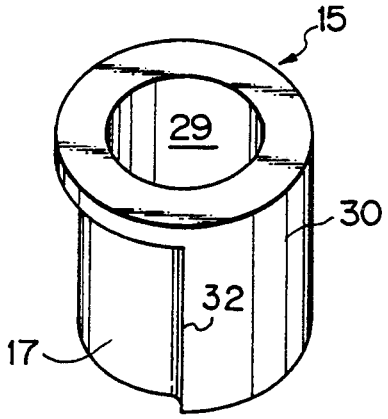
FIG. 3C is a perspective view of the rotary valve of FIGS. 3A and 3B.
Figure 4:
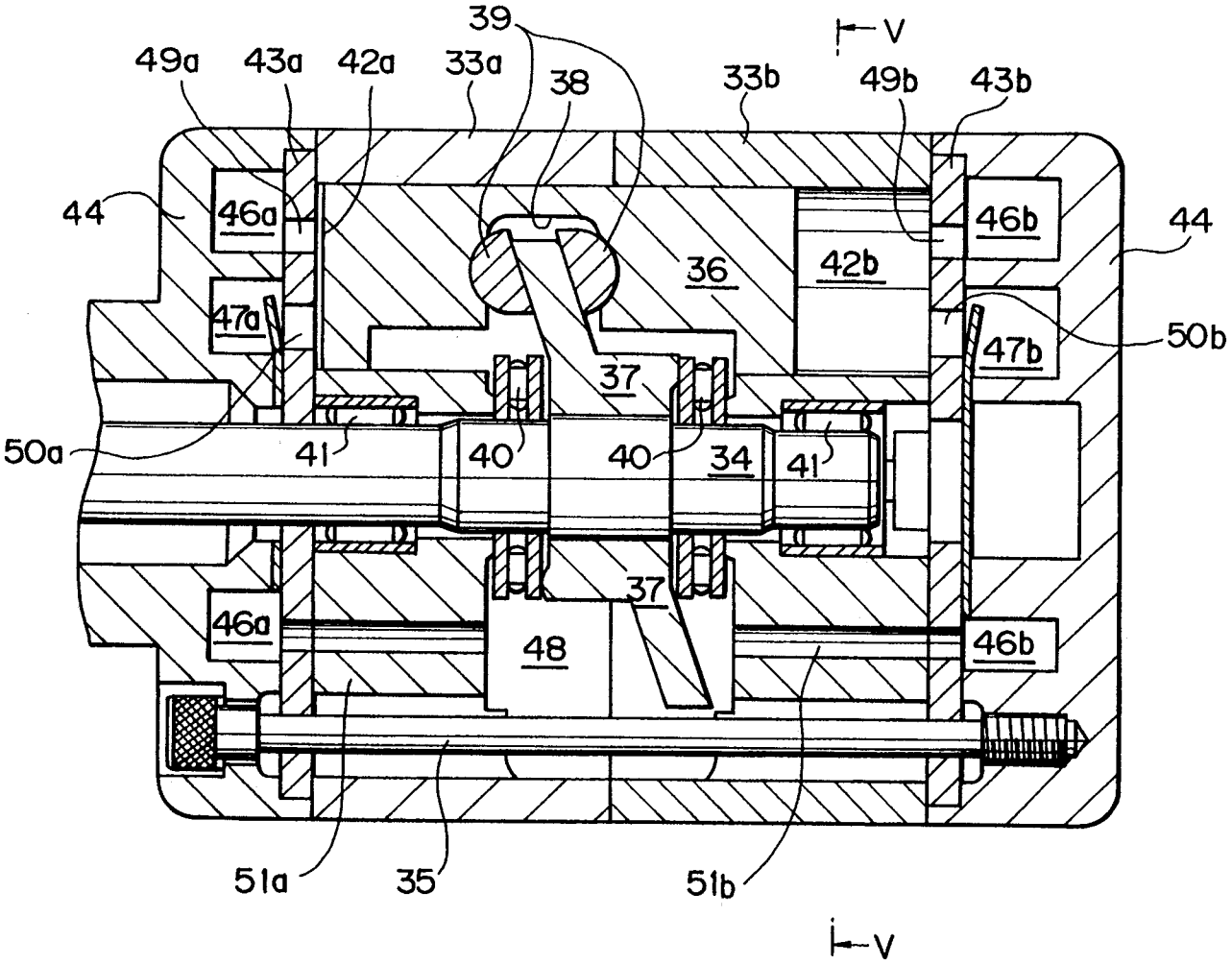
Fig. 4 (PRIOR ART)
FIG. 4 is a longitudinal cross-sectional view of a swash plate type refrigerant compressor according to the prior art.
Figure 5:
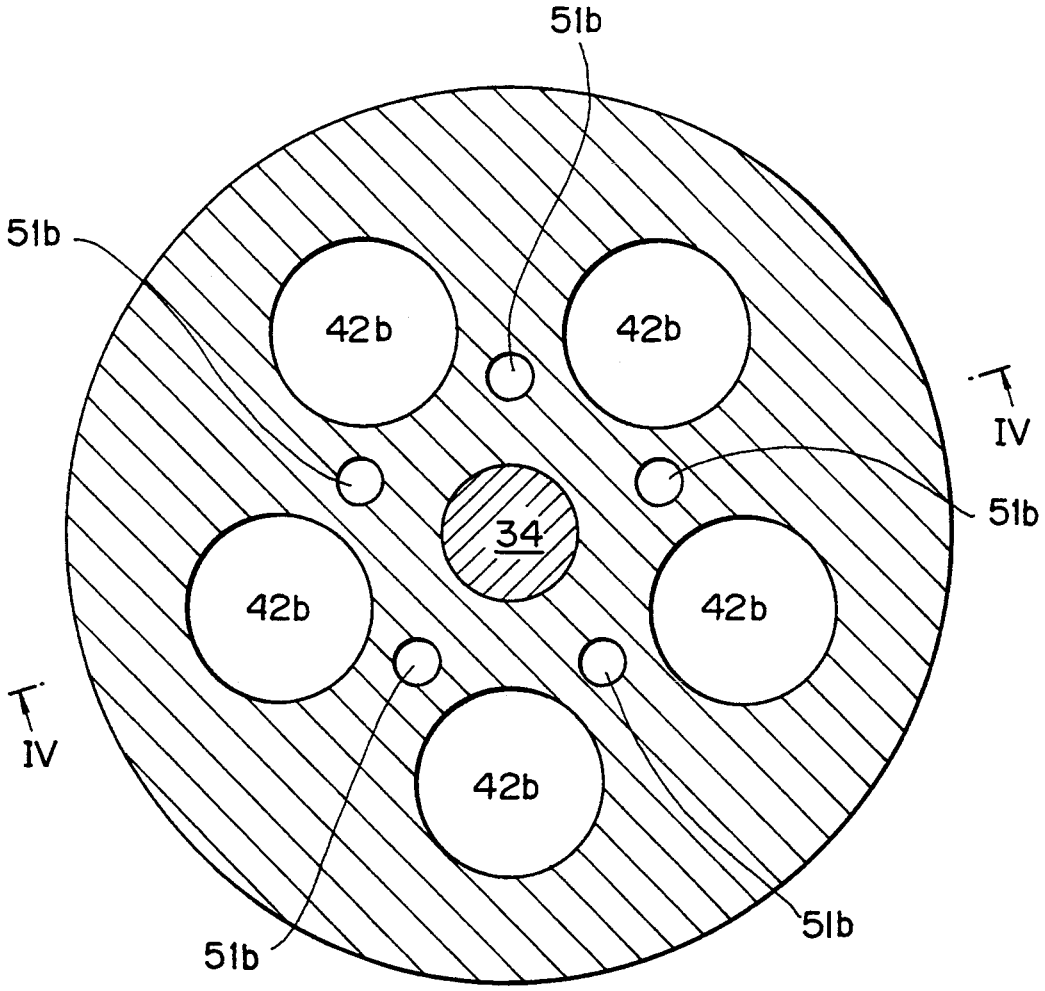
Fig.5 (PRIOR ART)
FIG. 5 is a cross-sectional view taken along the line V—V of FIG. 4.

A pair of rotary valves 15 are mounted on the drive shaft 4, and axially arranged on both sides of the swash plate 3. The pair of rotary valves 15 in the form of a cylindrical element as best shown in FIG. 3C are fitted on ther drive shaft 4, and are integrally connected to the swash plate 3 by an appropriate connecting means such as keys 3a shown in FIG. 1. Therefore, the rotary valves 15 rotate together with the drive shaft 4 and the swash plate 3. The front side one (the leftmost one) of the pair of rotary valves 15 is provided for controlling the suction of the refrigerant gas from the swash plate chamber 19 into each of the front cylinder bores 14a in association with the reciprocation of the double-headed pistons 11, and the rear side one of the rotary valves 15 is provided for controlling the suction of the refrigerant gas from the swash plate chamber 19 to each of the rear cylinder bores 14b in association with the reciprocation of the double-headed pistons 11. Namely, the pair of rotary valve elements 15 control appropriate distribution of the refrigerant gas before compression from the swash plate chamber 19 to respective front and rear cylinder bores 14a and 14b at such a predetermined time as synchronized with the suction phase of respective cylinder bores 14a and 14b.

Figure 2:
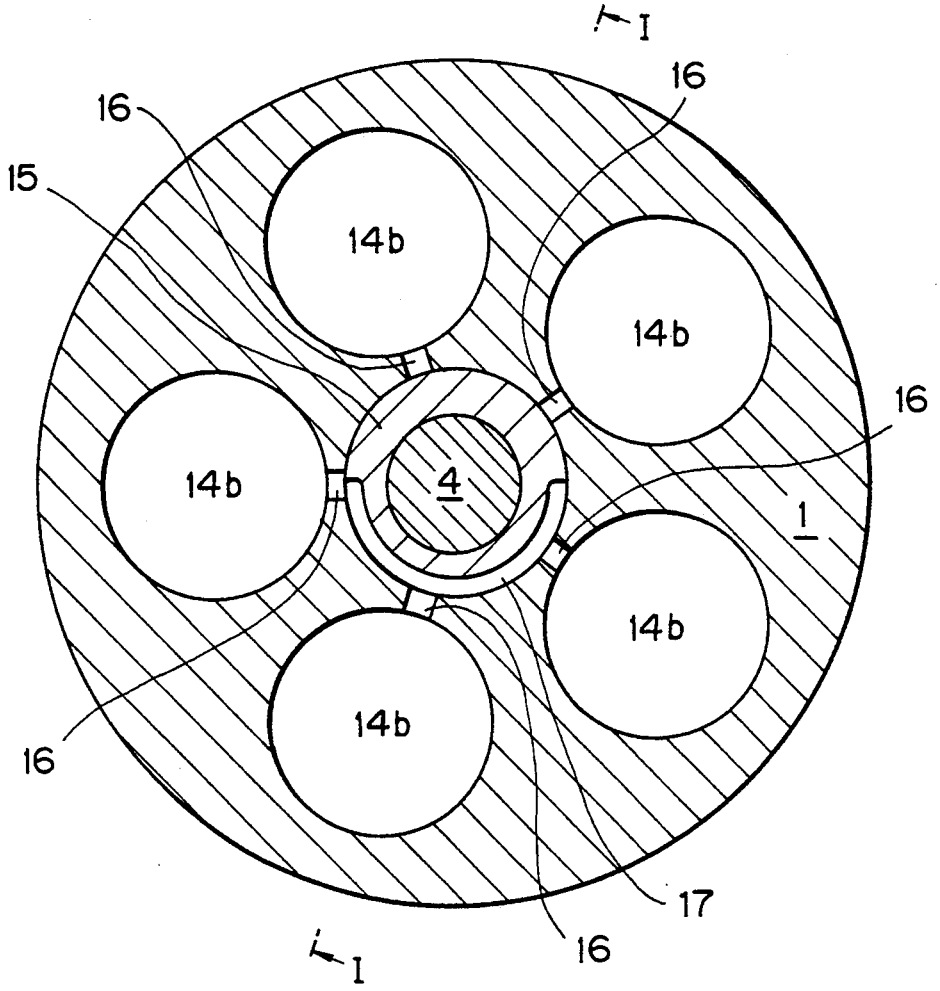
FIG. 2 is a cross-sectional view taken along the line II—II of FIG. 1.

In order to achieve such appropriate distribution of the refrigerant gas from the swash plate chamber 19 to the front and rear cylinder bores 14a and 14b during the rotation of the pair of rotary valves 15, each of the rotary valves; 15 is provided with a later-described suction passageway 17 in the form of a cutout formed on the outer surface of the cylindrical rotary valve 15. Further, the front and rear cylinder blocks 1 and 2 are provided with a plurality of bore-like suction ports 16 formed therein so as to open toward respective front and rear cylinder bores 14a and 14b (see FIGS. 1 and 2). Namely, during the rotation of the rotary valves 15, when the suction passageways 17 of the front and rear side rotary valves 15 come into registration with respective suction ports 16 of the cylinder blocks 1 and 2, a fluid route is established between the swash plate chamber 19 and the front and rear cylinder bores 14a and 14b so that the refrigerant gas is permitted to flow from the swash plate chamber 19 into the cylinder bores 14a and 14b.

At this stage, it should be noted that each of the double-headed piston 11 reciprocating in the corresponding pair of axial cylinder bores 14a and 14b is formed with a pair of chamfered portions 12c and 12d at the radially innermost end of the recess 12. The chamfered portions 12c and 12d are capable of contributing to causing a smooth flow of the refrigerant gas from the swash plate chamber 19 toward the suction passageways 17 of the rotary valves 15. The shoulder of the swash plate may be provided with appropriate recessed portions 3b (FIG. 1) so as to further promote the smooth flow of the refrigerant gas from the swash plate chamber 19 toward the suction passageways 17 of the rotary valves 15.

The construction and operation of the above-mentioned rotary valves 15 will be provided hereinbelow with reference to FIGS. 3A through 3C.

The rotary valve 15 in the form of a cylindrical hollow element having an axial bore 29 is provided with the suction passageway 17 in the form of a circumferentially extending cutout between two axial edges 31 and 32. In the present embodiment used for the five cylinder bore type compressor, the cutout forming the suction passageway 17 extends through an angle of 180 degrees between the two edges 31 and 32 with respect to the central axis of the rotary valve 15. However, the circumferential angles of the suction passageway 17 is not restrained to 180 degrees, and may be changed as required from the point of view of the design of the compressor.

The rotary valve 15 is also provided with an annular rim 28 at one axial end thereof. The annular rim 28 is abutted against the cylinder block 1 or 2 when the rotary valve 15 is fitted onto and keyed to the drive shaft 4, and accordingly, the axial position of the rotary valve 15 on the drive shaft 4 is determined in such a manner that an end of the suction passageway 17 of the rotary valve 15 is located adjacent to at least one of the front cylinder bores 14a or the rear cylinder bores 14b of the cylinder blocks 1 and 2.

The other axial end of the rotary valve 15 is fixed to the swash plate 3 in such a manner that an open end of the suction passageway 17 of the rotary valve 15 is constantly communicated with the swash plate chamber 19.

An outermost circumference 30 of the rotary valve 15 is preferably coated with a layer of slidable material such as synthetic resin or polymer material.

When the pair of rotary valves 15 mounted on the drive shaft 4 rotate together with the drive shaft 4 and the swash plate 3, the suction passageways 17 of the two rotary valves 15 subsequently come in registration with respective pairs of front and rear cylinder bores 14*a* and 14*b*.

At this stage, during one complete rotation of the drive shaft 4 and the swash plate 3, each of the double-headed pistons 11 carries out one complete reciprocation in the corresponding pair of front and rear cylinder bores 14*a* and 14*b*, and thus the double-headed piston 11 accomplishes the suction, compression, and discharge strokes thereof for the pair of front and rear cylinder bores 14*a* and 14*b*. Therefore, the suction passageways 17 of the two rotary valves 15 fitted on the drive shaft 4 must be circumferentially arranged in such a manner that the suction passageways 17 extending between the edges 31 and 32 are continuously in registration with the suction port 16 of the cylinder 14*a* or 14*b* of the pair of cylinder bores 14*a* and 14*b* that is in the suction phase. When each of the double-headed pistons 11 implements the suction stroke thereof, the suction passageway 17 of each of the two rotary valves 15 is in communication with each of the pair of cylinder bores 14*a* and 14*b* to thereby permit the refrigerant gas to flow from the swash plate chamber 19 into the cylinder bores 14*a* and 14*b* through each suction passageway 17, and each suction port 16. When each double-headed piston 11 implements the compression stroke, each of the rotary valves 15 interrupts communication between each of the pair of cylinder bores 14*a* and 14*b* and the swash plate chamber 19. Namely, the outermost circumference 30 of each rotary valve 15 closes the suction port 16 of each of the pair of cylinder bores 14*a* and 14*b* as best shown in FIG. 3B.

From the foregoing description, it will be understood that in accordance with the present invention, suction chambers for the refrigerant gas before compression are eliminated from the housings of the swash plate type refrigerant compressor. Namely, since the swash plate chamber can act as a refrigerant receiving chamber and since the rotary valves mounted on and rotating together with the drive shaft control the distribution of the refrigerant gas from the swash plate chamber into the front and rear cylinder bores of the compressor, the suction route for the refrigerant gas within the compressor body can be appreciably shortened. Thus, pressure loss during the suction of the refrigerant gas is reduced to thereby prevent the heating of the refrigerant gas before compression and also compression efficiency of the compressor can be raised.

Further, the employment of the rotary valves is able to able to contribute not only to reduction of pressure loss compared with the conventional reed-form valves but also to smooth suction of the refrigerant gas. Consequently, reduction of noise that was generated by the suction motion of the reed valves of the conventional swash plate type refrigerant compressor can be achieved.

Further, since the rotary valve is not broken by physical fatigue that is an important cause of breakage of the conventional reed valve, the rotary valve can have an operating life far longer than that of the conventional reed valve.

Furthermore, in the swash plate type compressor of the present invention, a pair of taper roller bearings for rotatably supporting the drive shaft are arranged in the front and rear housings attached to the front and rear ends of the cylinder block assembly. The taper roller bearings are able to assume thrust force acting on the drive shaft via the swash plate. Therefore, compared with the conventional swash plate type compressor employing both the pair of anti-friction radial bearings and the pair of thrust bearing, the number of the bearings of the compressor of the present invention can be small, and accordingly, the assembly of the swash plate type compressor is simplified. Thus, it is possible to reduce manufacturing cost of the swash plate type refrigerant compressor, and to increase the operating reliability of the compressor.

In addition, since the pair of taper roller bearings are arranged outside the cylinder block assembly, the spacing between the two bearings is large enough to stably support the drive shaft rotating at a high speed as required. Thus, the quiet operation of the compressor can be ensured over a long operating life of the swash plate type compressor.

It should be noted that many variations and alternations may occur to persons skilled in the art without departing from the scope and spirit of the present invention claimed in the accompanying claims.

We claim:

1. A swash plate type refrigerant compressor comprising:

a cylinder block means provided with a plurality of axial cylinder bores arranged around an axis thereof at a circumferential spacing between adjacent cylinder bores, and a swash plate chamber defined in a substantially middle portion thereof;

a plurality of reciprocatory pistons slidably fit in said plurality of cylinder bores;

an axial drive shaft rotatably supported in said cylinder block means for receiving an external drive power applied thereto;

a swash plate fixedly mounted on said drive shaft so as to rotate in said swash plate chamber together with said drive shaft, said swash plate being operatively engaged with and reciprocating said plurality of reciprocatory pistons during the rotation thereof;

a gas inlet means provided in said cylinder block means for introducing a refrigerant gas before compression from the exterior of said compressor into said swash plate chamber of said cylinder block means; and a rotary valve means mounted on said drive shaft so as to be rotated together with said drive shaft, said rotary valve means being provided with at least one gas passageway formed therein and capable of establishing a fluid route enabling the refrigerant gas before compression to be distributed from said swash plate chamber to each of the plurality of cylinder bores during only suction stroke of each of said plurality of pistons in each of said plurality of cylinder bores, said rotary valve means being further provided with means for blocking said fluid route during the compression stroke of each of said plurality of pistons in each of said plurality of cylinder bores of said cylinder block means.

2. A swash plate type refrigerant compressor according to claim 1, wherein said compressor further comprises a housing means sealingly attached to ends of said cylinder block means for providing therein a discharge chamber for the refrigerant gas after compression, said discharge chamber being fluidly communicated with said plurality of cylinder bores during a discharge stroke of each of said pistons in each of said plurality of cylinder bores to thereby receive the refrigerant gas after compression discharged from each of said plurality of cylinder bores.

3. A swash plate type refrigerant compressor according to claim 2, wherein said drive shaft is axially extended through a central portion of said cylinder block means and rotatably supported by a bearing means capable of assuming both radial and thrust loads acting on said drive shaft and said swash plate, said bearing means being arranged in said housing means.

4. A swash plate type refrigerant compressor according to claim 1, wherein said cylinder block means is provided with a hollow cylindrical wall at a center thereof defining a central bore in which said drive shaft is mounted, said hollow cylindrical wall is formed with a plurality of suction ports formed adjacent to said plurality of cylinder bores, said suction ports being in registration with said gas passageway of said rotary valve means during the rotation of said rotary valve means together with said drive shaft.

5. A swash plate type refrigerant compressor according to claim 4, wherein said rotary valve means comprises a hollow cylindrical element having an outermost cylindrical circumference portion and a circumferentially extending recess portion, said rotary valve means being slidably fitted in said central bore of said cylinder block means, said outermost cylindrical circumference portion of said rotary valve means forming said blocking means, and said circumferentially extending recess portion forming said gas passageway of said rotary valve means.

6. A swash plate type refrigerant compressor comprising:

a cylinder block means provided with a plurality of pairs of front and rear cylinder bores arranged around an axis thereof at a circumferential spacing between adjacent cylinder bores, and a swash plate chamber defined in a substantially middle portion thereof;

a plurality of double-headed reciprocatory pistons slidably fit in said plurality of pairs of front and rear cylinder bores for effecting suction, compression, and discharge of refrigerant gas;

an axial drive shaft rotatably supported in said cylinder block means, and having an outer end thereof connectable to an external drive power source;

a swash plate fixedly mounted on said drive shaft so as to rotate in said swash plate chamber together with said drive shaft, said swash plate being operatively engaged with and reciprocating said plurality of reciprocatory pistons during the rotation thereof;

a gas inlet means provided in said cylinder block means for introducing a refrigerant gas before compression from the exterior of said compressor into said swash plate chamber of said cylinder block means;

front and rear housings fixedly attached to front and rear ends of said cylinder block means, said front and rear housings defining therein a discharge chamber for receiving the refrigerant gas after compression;

a pair of taper roller bearing means mounted in said front and rear housings for rotatably supporting said drive shaft; and a pair of front and rear rotary valves mounted on said drive shaft so as to be rotated together with said drive shaft, said front rotary valve being operable to control distribution of the refrigerant gas before compression from said swash plate chamber to said front cylinder bores, and said rear rotary valve being operable to control distribution of the refrigerant gas before compression from said swash plate chamber to said rear cylinder bores.

7. A swash plate type refrigerant compressor according to claim 6, wherein said front rotary valves being provided with at least one gas passageway formed therein and capable of establishing a fluid route enabling the refrigerant gas before compression to be distributed from said swash plate chamber to each of said front cylinder bores, and wherein said rear rotary valves being provided with at least one gas passageway formed therein and capable of establishing a fluid route enabling the refrigerant gas before compression to be distributed from said swash plate chamber to each of said rear cylinder bores.

8. A swash plate type refrigerant compressor according to claim 7, wherein each of said front and rear rotary valves is provided with means for blocking said fluid route during the compression stroke of each of said plurality of double-headed pistons within each of said plurality of pairs of front and rear cylinder bores of said cylinder block means.

* * * * *